United States Patent [19]

Cameron et al.

[11] Patent Number: 4,915,732

[45] Date of Patent: Apr. 10, 1990

[54] DESULFURIZING IRON

[75] Inventors: Ian A. Cameron, Hamilton; Lorne E. Murphy, Burlington, both of Canada

[73] Assignee: Stelco Inc., Hamilton, Canada

[21] Appl. No.: 349,481

[22] Filed: May 9, 1989

[30] Foreign Application Priority Data

Jun. 6, 1988 [CA] Canada ..... 568752

[51] Int. Cl.[4] ..... C21C 7/02

[52] U.S. Cl. ..... 75/536; 75/537

[58] Field of Search ..... 75/53, 58

[56] References Cited

U.S. PATENT DOCUMENTS 3,998,625 12/1976 Koros ..... 75/58
4,266,969 5/1981 Koros ..... 75/58
4,277,279 7/1981 Kerlin et al. ..... 75/58

FOREIGN PATENT DOCUMENTS 1188520 6/1985 Canada .
1188521 6/1985 Canada .

*Primary Examiner*—Peter D. Rosenberg
*Attorney, Agent, or Firm*—Sim & McBurney

[57] ABSTRACT

The efficiency of the use of desulfurizing agents, particularly calcium carbide- and calcium oxide-based desulfurizing agents, to decrease the sulfur content of molten iron is improved by adding a pulse of magnesium, aluminum or calcium metal at a critical concentration of sulfur and oxygen in the molten metal. The improved efficiency enables less desulfurization agent to be employed for the same residual sulfur concentration, with consequently decreased reaction time and costs.

20 Claims, 4 Drawing Sheets

DESULFURIZING IRON

FIELD OF INVENTION

The present invention relates to desulfurizing molten iron to very low sulfur contents.

BACKGROUND TO THE INVENTION

It is desirable to decrease the sulfur content of molten iron, such as pig iron and cast iron, for use in steel production. Initial sulfur levels of molten iron generally range from about 0.015 to about 0.15 wt. %S. Low sulfur content iron, generally below about 0.005 wt. %S, is a prerequisite for low sulfur steels, which have improved physical properties, lower inclusion contents and decreased cracking tendency.

Desulfurization usually is effected during transfer from the blast furnace producing the molten iron to the steel-making operation. For this purpose, desulfurization agents, including lime, calcium carbide and magnesium-containing reagents, have been employed. Typical prior art known to the applicants includes U.S. Pat. Nos. 3,998,625, 4,266,969 and 4,277,279 and Canadian Patents Nos. 1,188,520 and 1,188,521. Many other prior patents are also referred to in this prior art.

These prior art processes involve injection into the molten iron of a single powder mixture, which may involve two or more reagents, including mixtures of lime and magnesium and calcium carbide and magnesium. When such mixtures are used, the components are injected into the molten iron simultaneously from the start to finish of the desulfurizing process. Usually, such mixtures contain the same quantity of each reagent during the injection process. In U.S. Pat. No. 3,998,625, the desulfurizing process.

SUMMARY OF THE INVENTION

It has now surprisingly been found that the efficiency of desulfurizing of molten iron using calcium carbide, lime and similar desulfurizing agents can be significantly improved by injecting a small amount of magnesium or similarly-acting metal into the molten metal at a preselected point in the overall desulfurizing agent injection process.

While the applicants do not wish to be bound by any theory as to the mechanism involved in the desulfurizing process, it is believed that the magnesium decreases oxygen activity in the molten iron at a critical stage of the desulfurizing operation. Research performed by the inventors has indicated that molten iron contains more oxygen than was previously believed to be the case. At low sulfur levels, namely below about 0.015 wt. %S, the desulfurizing potential of the desulfurizing agent seems to be significantly decreased by the equation:

$$CaS + \underline{O}\ CaO + \underline{S} \qquad (1)$$

The addition of the magnesium or other oxidation-inhibiting metal when the sulfur content of the molten metal reaches 0.015 wt. %S, decreases the activity of the oxygen in the molten metal, and thereby minimizes the reaction of equation (1). Minimizing the oxidation reaction at this critical sulfur content permits the desulfurizing agent to continue to react efficiently with the sulfur and enables a desired final sulfur level, for example, less than 0.004 wt. %S, to be achieved.

The pulse addition of the magnesium at the critical sulfur concentration results in a considerable saving in the amount and hence cost of desulfurizing agent, as compared with the use of desulfurizing agent alone to achieve a given residual sulfur concentration. Since the desulfurizing agent usually is added at a constant rate to the molten iron, the decreased usage of desulfurizing agent results in an overall shorter treatment time. Depending on the desired final sulfur content, savings of up to about 40% of material usage and reaction time can be achieved.

Another significant advantage that results from the decreased usage of desulfurizing agent is a decrease in the temperature loss of the molten iron during the treatment. Although the decrease in temperature loss is only a few degrees, generally about 5° to 10° C., this decrease in temperature loss translates into significant cost savings in the overall steel-making process.

In accordance with the present invention, therefore, there is provided a method of desulfurizing molten iron, which comprises injecting a desulfurizing agent into the molten iron until the sulfur content of the molten metal is about 0.015 wt.%; injecting a sulfide-oxidation inhibiting amount of a metal selected from magnesium, aluminum and calcium into the molten iron simultaneously with the desulfurizing agent; and thereafter continuing injection of the desulfurizing agent to a predetermined residual sulfur concentration in the molten iron.

GENERAL DESCRIPTION OF INVENTION

Figure 1:
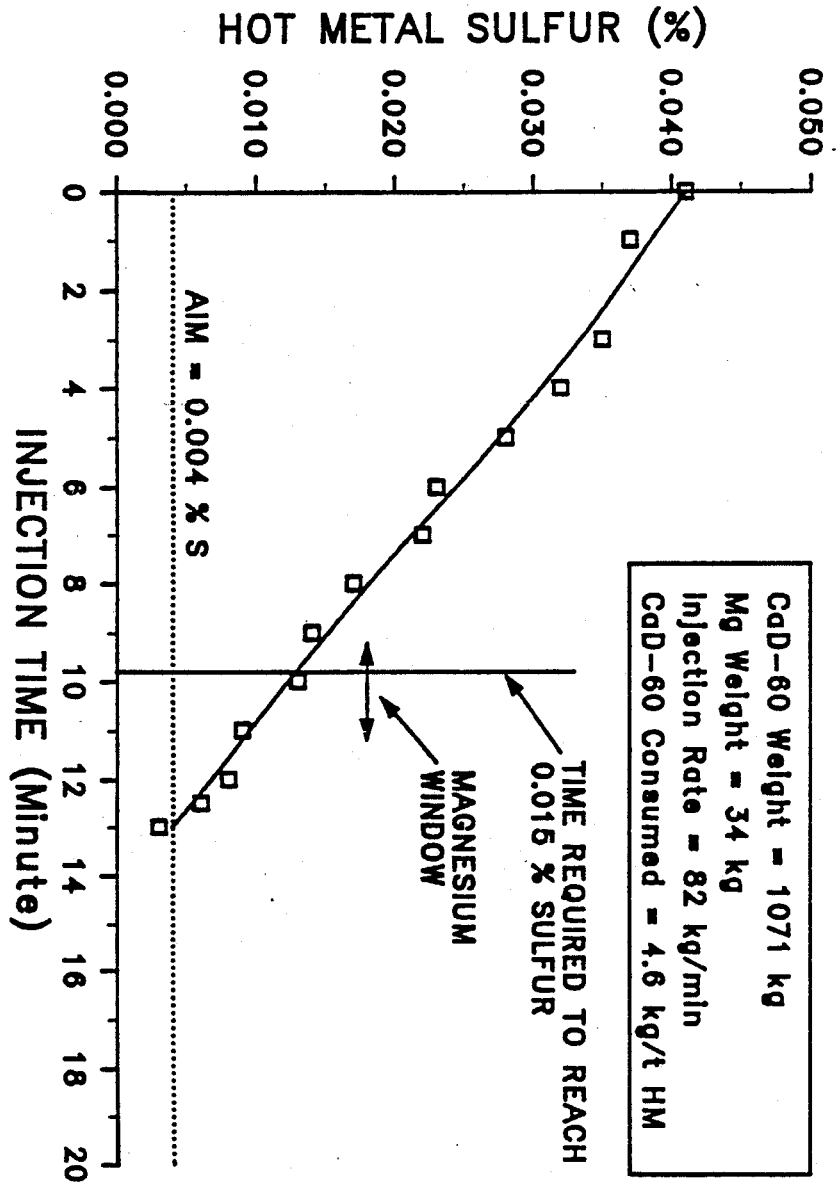
FIG. 1 is a graphical representation of the change in sulfur content of molten iron using a desulfurizing procedure in accordance with the present invention.

The invention is described more particularly with reference to the use of a calcium carbide mixture as the desulfurizing agent and of magnesium metal as the metal but it will be appreciated that the equivalent results are attainable using other materials, as described in detail below.

The timing of the magnesium addition to inhibit oxidation of calcium sulfide is important, since magnesium itself is known to be a strong desulfurizer and does not suppress oxygen activity at significant sulfur levels. In this regard, the applicants have found that, at a residual sulfur content about 0.015 wt. %S of the molten metal, oxidation of CaS becomes the predominant reaction and the quantity of calcium carbide required to achieve an incremental decrease in the sulfur concentration of the molten metal increases significantly.

It is necessary for the magnesium to be present in the molten metal before that condition is reached for the invention to be effective. Accordingly, commencement of injection of magnesium into the molten metal usually occurs at a slightly higher sulfur level than the critical one, so that magnesium has been added by the time the critical sulfur concentration has been reached. On the other hand, if injection of magnesium is commenced at too high a sulfur concentration, the process is ineffective.

The feed of calcium carbide is maintained during the injection of the magnesium and is continued after the magnesium injection is complete. The injection of magnesium at the critical residual molten iron sulfur concentration enables the calcium carbide desulfurization agent to be continued to be injected at the same rate for the same incremental decrease in sulfur concentration after the magnesium addition is complete. Desulfurization of the molten iron can be continued to a desired level, as required for feed to the steel plant, usually in the range of about 0.005 wt. %S to about 0.005 wt. %S. One typical concentration is 0.004 wt. %S.

Since the use of a short pulse of magnesium during injection of desulfurizing agent maintains the incremental decrease in sulfur concentration, the desired residual sulfur concentration is achieved with much lower reagent consumption and at lower cost than with calcium carbide alone. In addition, the decreased reagent consumption decreases processing time and therefore, enables a greater throughput of the desulfurizing station to be achieved.

The present invention contrasts with prior art molten iron desulfurization procedures by injection a discrete amount of magnesium at a critical point during the course of desulfurizing agent injection into the molten iron, in contrast to procedures in which a second reagent, such as magnesium, is added over the same period of time as the first reagent, either at a uniform feed rate or at a declining feed rate. In addition, in the present invention, magnesium is specifically added for a short period of time to minimize the reaction of oxygen with calcium sulphide (equation (1)) and not to desulfurize hot metal by continuous addition of magnesium.

Desulfurization is effected in the process of the invention using any convenient desulfurizing agent. Desulfurization agents which are useful in the present invention include oxides, carbides, nitrides and silicides of calcium, magnesium, aluminum and silicon, as well as mixtures of two or more of such compounds.

The desulfurizing agents most commonly employed in the process of the present invention are calcium carbide, calcium oxide and calcium carbonate, since these materials are currently the most commonly employed in conventional molten iron desulfurization procedures. It is preferred to employ a mixture of calcium carbide, calcium oxide and calcium carbonate.

Upon injection of the mixture of calcium carbide, calcium oxide and calcium carbonate into the molten iron, decomposition of the calcium carbonate immediately occurs, releasing carbon dioxide in the mass of molten iron. The resulting turbulence significantly promotes distribution of the desulfurizing agent throughout the mass of molten iron, thereby further improving the effectiveness of the desulfurizing agent.

Generally, in the preferred embodiment of the invention, the composition of the calcium carbide mixture may vary widely, from about 45 to about 80 wt.% $CaC_2$, from 0 up to about 40 wt.% $CaCO_3$ and about 10 to about 20 wt.% CaO.

The desulfurization may be effected at any stage of transfer of molten iron from the blast furnace to the steel-making plant. The molten iron may have a temperature generally in the range of about 1200° to about 1600° C. during the desulfurization treatment.

It has been found that the oxidation reaction is temperature sensitive, in that, as the molten iron temperature decreases to lower levels, reagent consumption to achieve the desired final sulfur content increases substantially. For this reason, the molten iron preferably has a temperature in the range of about 1440° to about 1480° C. in torpedo ladles.

The calcium carbide mixture or other desulfurizing agent is added to the molten iron generally at a rate of about 50 to about 150 kg/min, preferably about 80 to about 100 kg/min, for a period of time necessary to decrease the sulfur content to around 0.015 wt. %S, usually about 10 to 30 minutes, depending on the initial sulfur concentration and the weight of molten iron. The quantity of desulfurizing agent and the time required to achieve this level of residual sulfur generally are determined by calculation from the sulfur concentration initially present, the rate of feed of the desulfurizing agent and the quantity of iron to be treated.

When this critical residual concentration of sulfur is present in the molten iron, magnesium is fed to the molten iron while the feed of calcium carbide mixture is continued at the same rate. The magnesium is added generally as granules, usually coated with dolomite or salt for safety, and typically comprising 90% Mg metal. The coated granules may be sized 0.1 to 1 mm. As alternatives to magnesium, aluminum and calcium also may be used in the process of the present invention to inhibit oxidation of sulfides at the critical sulfur content.

The magnesium or other oxidation-inhibiting metal is rapidly added to the molten iron at a rate of about 1 to about 40 kg/min, preferably about 12 to about 16 kg/min, over a period of about 1 to about 4 mins, preferably about 2 mins. The magnesium generally is added as rapidly as possible to a total quantity of about 0.1 to about 0.2 kg/tonne of molten iron as magnesium granules. As explained earlier, feed of desulfurizing agent is continued during magnesium addition. Generally, the magnesium is fed to the feed pipe for the desulfurizing agent to the molten iron, so as to be mixed with and be coinjected with the desulfurizing agent.

Following completion of the introduction of the magnesium to the molten iron, the addition of calcium carbide is continued at the same feed rate to the final target sulfur content. As explained above, the target sulfur concentration in the molten iron depends on the sulfur concentration required by the steel-making plant and usually is below 0.005 wt. %S. The time for which desulfurization agent is continued to be added generally is about 1 to about 6 minutes, preferably about 1 to about 2 minutes, depending on the target sulfur concentration.

From the above description, it will be seen that the present invention involves a molten iron desulfurization procedure in which an improved efficiency of use of desulfurizing agent is achieved, leading to a decreased reaction time and decreased desulfurization agent usage to the same residual sulfur concentration, as well as a lesser drop in temperature during desulfurization. These highly beneficial results are achieved by the pulse addition of magnesium, aluminum or calcium at a critical residual sulfur concentration.

EXAMPLES

EXAMPLE 1

200 tonnes of molten iron having a temperature estimated to be approximately 1400°C. and having a sulfur content of about 0.040 wt. %S were treated with 1071 kg of a desulfurizing agent containing 48% $CaC_2$, 29% $CaCO_3$ and 23% CaO (identified as "CaD-60") at an injection rate of 82 kg/min.

After 9 minutes of injection of CaD-60, 34 kg of dolomite-coated granules of magnesium (90 wt.% Mg) were added over a period of three minutes along with the CaD-60. Thereafter, CaD-60 injection was continued for a further minute.

The sulfur content of the molten metal was determined at regular intervals during the experiment and the results were plotted graphically. FIG. 1 reproduces those results.

Figure 4:
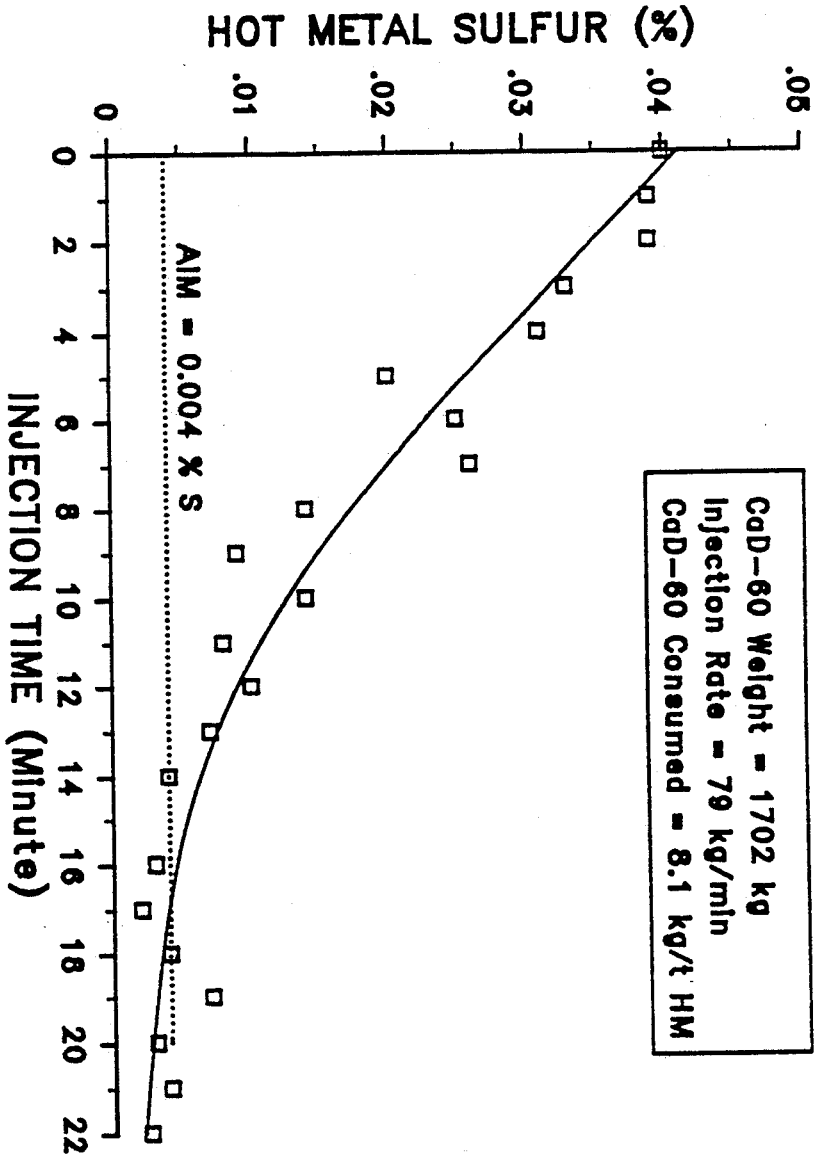
FIG. 4 is a graphical representation of the change in sulfur content of molten iron using a conventional desulfurizing procedure.

The procedure was repeated using 1702 kg of CaD-60 at an injection rate of 79 kg/min for 22 minutes. The sulfur content of the molten metal was determined at regular intervals during the experiment and the results were plotted graphically. FIG. 4 reproduces these results.

As may be seen from the graphical data, in the case of FIG. 1 when the magnesium was injected, the decrease in sulfur concentration continued on a straight line path to reach the target residual sulfur concentration in about 15 minutes at a total consumption of CaD-60 of 4.6 kg/t of hot metal.

However, when no injection of magnesium was made, as in FIG. 4, the graph flattens out as the consumption of desulfurizing agent significantly increases below about 0.015 wt. %S. The total consumption of CaD-60 was 8.1 kg/t of hot metal, i.e. significantly greater.

EXAMPLE 2

The procedure of Example 1 was repeated on molten iron having a sulfur content of 0.030 wt. %S. In this case 1026 kg of a desulfurizing agent containing 56% $CaC_2$, 22% $CaCO_3$ and 22 wt.% CaO (designated "Stelco Mix") was employed at an injection rate of 103 kg/min. 34 kg of dolomite-coated granules of magnesium were added over a period of three minutes.

Figure 2:
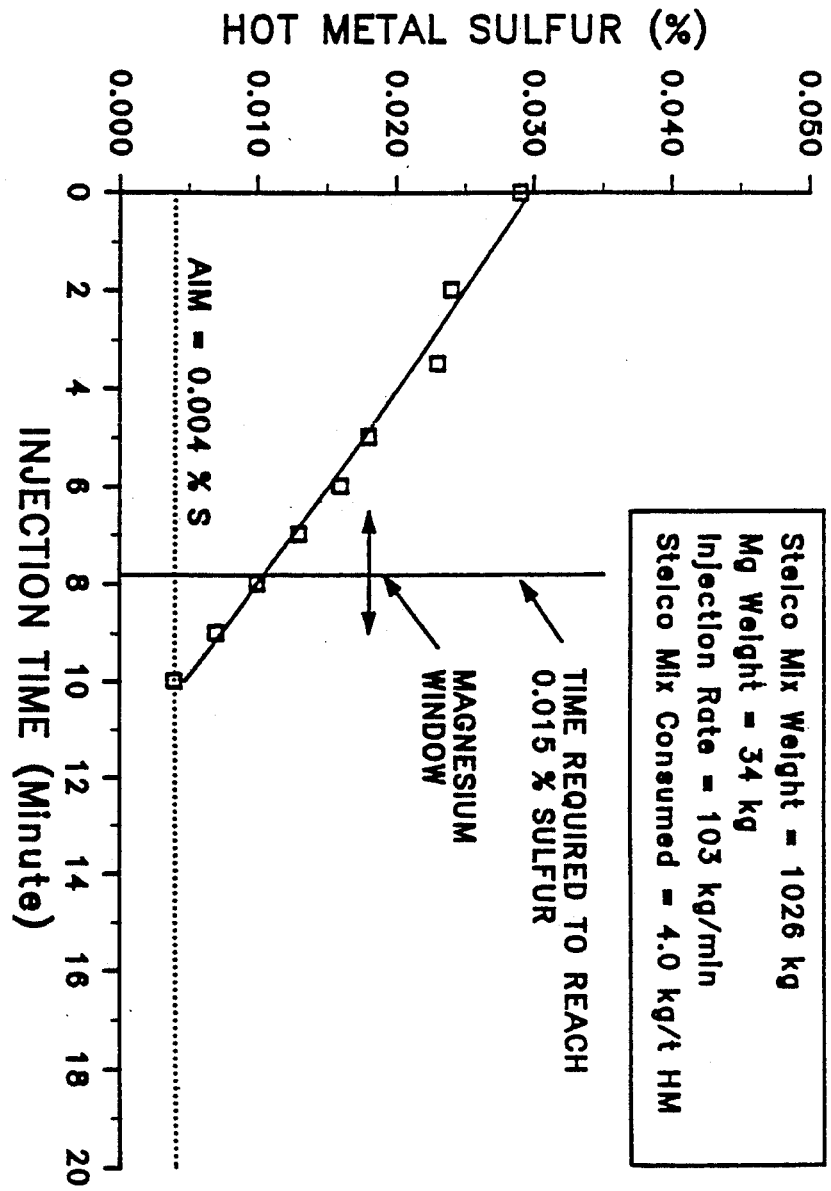
FIG. 2 is another graphical representation of the change in sulfur content of molten iron using a desulfurizing procedure in accordance with the present invention.

The results of sulfur content determinations with time again were plotted graphically against time and the results appear in FIG. 2. In this case, with a desulfurizing agent consumption of 4.0 kg/tonne, a sulfur content of 0.004 wt. %S was achieved in 10 minutes with a straight-line decrease of sulfur content with time.

EXAMPLE 3

A significant number of additional desulfurization tests were carried out using CaD-60 desulfurizing agent and Stelco Mix desulfurizing agent with pulse addition of magnesium at approximately 0.015 wt. %S residual sulfur to a final sulfur content of 0.004 wt. %S from an average initial sulfur content of 0.033 wt. %S for the tests using CaD-60 desulfurizing agent and of 0.040 wt. %S for the tests using Stelco Mix.

Figure 3:
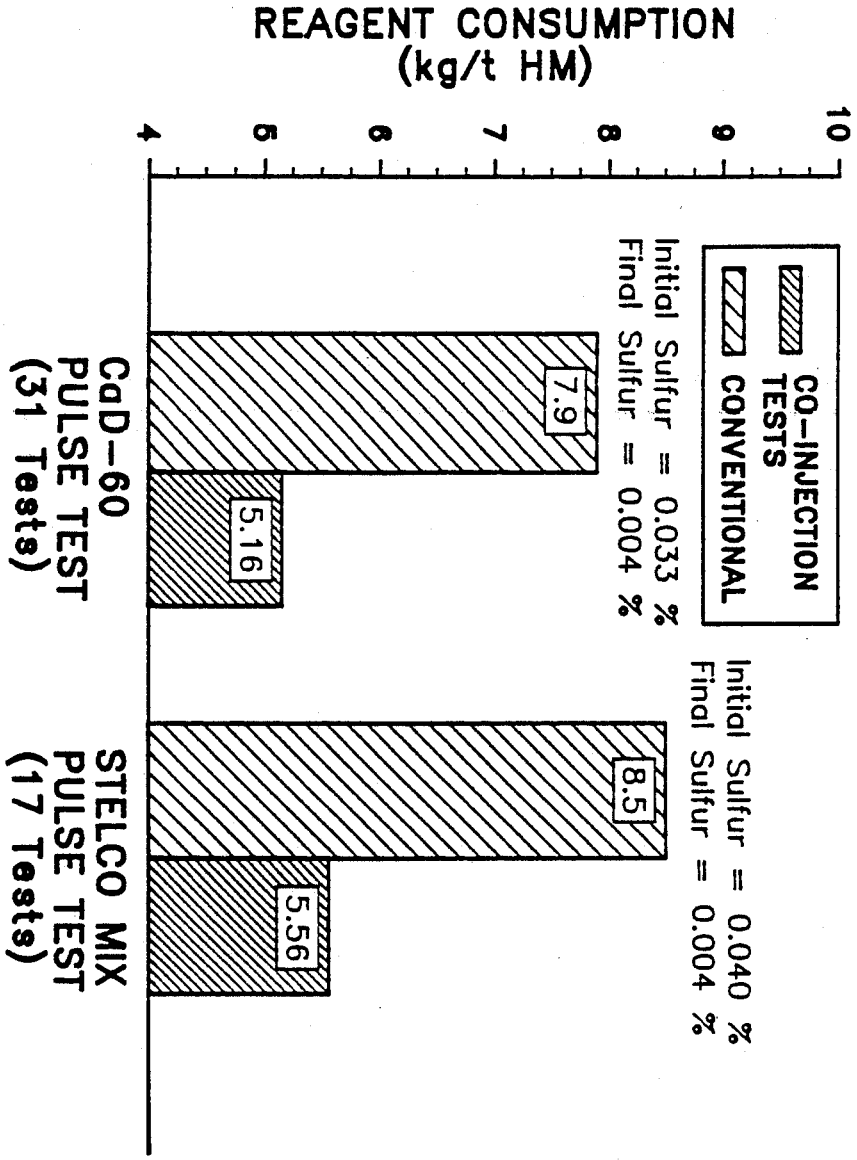
FIG. 3 is a bar graph summarizing the results of a large number of tests and illustrating the savings in quantity of desulfurizing agent and corresponding time saving.

The reagent consumption averaged, for desulfurizing agent, 5.0 kg/t for the tests using CaD-60 and 5.4 kg/t for the tests using Stelco Mix and 0.16 kg/t of magnesium in all tests. The total reagent consumption then was compared with consumption figures for conventional desulfurizing using the desulfurizing agent alone to achieve the same residual sulfur concentration. The average results are presented in bar graph form in FIG. 3. As can be seen an average total reagent consumption decrease of 2.7 kg/t (approximately 34%) was achieved for CaD-60 and of 3.0 kg/t (approximately 35%) was achieved for Stelco Mix.

On the basis of these average consumptions, current costs of conventional use of CaD-60 desulfurizing agent are \$4.08/t while for the inventive process are \$3.39/t (\$2.58 for CaD-60 and \$0.81 for Mg), thus saving \$0.69/t (approximately 17%). Current costs for conventional use of Stelco Mix are \$4.39/t while for the inventive process are \$3.89/t (\$3.08 for Stelco Mix and \$0.81 for Mg), thus saving \$0.50/t (approximately 11%).

SUMMARY OF DISCLOSURE

In summary of this disclosure, the present invention provides a novel desulfurization procedure for decreasing the sulfur content of molten iron to a desired level, in which magnesium is used for deoxidation at a critical stage of desulfurization to achieve improved overall desulfurizing efficiency. Modifications are possible within the scope of the invention.

What we claim is:

1. A method of desulfurizing molten iron, which comprises:

injecting a desulfurizing agent other than a metal selected from magnesium, aluminum and calcium into the molten iron until the sulfur content of said molten metal is about 0.015 wt.%, thereupon injecting a sulfide-oxidation inhibiting amount of a metal selected from magnesium, aluminum and calcium into said molten iron simultaneously with said desulfurizing agent, and thereafter continuing injection of said desulfurizing agent to a predetermined residual sulfur concentration ins aid molten iron.

2. The method of claim 1 wherein said desulfurization agent comprises oxides, carbides, nitrides and/or silicides of calcium, magnesium, aluminum and/or silicon.

3. The method of claim 1 wherein said predetermined residual sulfur concentration is in the range of about 0.005 to about 0.005 wt. %S.

4. The method of claim 3 wherein said desulfurizing agent is calcium carbide, calcium oxide, calcium carbonate or mixtures thereof.

5. The method of claim 1 wherein said metal is magnesium.

6. The method of claim 5 wherein said desulfurizing agent is a mixture comprising from about 45 to about 80 wt.% $CaC_2$, about 10 to about 20 wt.% CaO and from 0 up to about 40 wt.% $CaCO_3$.

7. The method of claim 5 wherein said molten iron has a temperature of about 1440° C. to about 1480° C. and said desulfurizing is effected in torpedo ladles.

8. The method of claim 5 wherein said desulfurizing agent is added to the molten iron at a rate of about 50 to about 150 kg/min until said predetermined residual sulfide sulfur concentration is achieved.

9. The method of claim 5 wherein said desulfurizing agent is added to the molten iron at a rate of about 80 to about 100 kg/min until said predetermined residual sulfur concentration is achieved.

10. The method of claim 5 wherein said desulfurizing agent is a mixture comprising about 45 to about 80 wt.% $CaC_2$, about 10 to about 20 wt.% CaO and from 0 up to about 40 wt.% $CaCO_3$ and said desulfurizing agent is added to the molten iron at a rate of about 50 to about 150 kg/min until said predetermined residual sulfur concentration is achieved.

11. The method of claim 5 wherein said desulfurization agent is a mixture comprising bout 45 to about 80 wt.% $CaC_2$, about 10 to about 20 wt.% CaO and from 0 up to about 40 wt.% $CaCO_3$ and said desulfurizing agent is added to the molten iron at a rate of about 80 to about 100 kg/min until said predetermined residual sulfur concentration is achieved.

12. The method of claim 3 wherein said metal is magnesium and, when said sulfur content of said molten metal has decreased to about 0.015 wt.%, the magnesium in granular form, is added to the molten iron at a rate of about 1 to about 40 kg/min over a period of about 1 to about 4 minutes.

13. The method of claim 12 wherein said magnesium is added to the molten iron at a rate of about 12 to about 15 kg/min for about 2 minutes.

14. The method of claim 12 wherein about 0.1 to about 0.2 kg/tonne of magnesium is added as rapidly as possible to said molten iron.

15. The method of claim 14 wherein said magnesium granules are fed to the molten iron in admixture with desulfurizing agent.

16. The method of claim 14 wherein said desulfurizing agent is a mixture comprising from about 45 to about 80 wt.% $CaC_2$, about 10 to about 20 wt.% CaO and from 0 to up to about 40 wt.% $CaCO_3$.

17. The method of claim 14 wherein said desulfurizing agent is a mixture comprising from about 45 to about 80 wt.% $CaC_2$, about 10 to about 20 wt.% CaO and from 0 to up to about 40 wt.% $CaCO_3$ and said desulfurizing agent is added to the molten metal at a rate of about 50 to about 150 kg/min until said predetermined residual sulfur concentration is achieved.

18. The method of claim 14 wherein said desulfurizing agent is a mixture comprising from about 45 to about 80 wt.% $CaC_2$, about 10 to about 20 wt.% CaO and from 0 to up to about 40 wt.% $CaCO_3$ and said desulfurizing agent is added to the molten metal at a rate of about 80 to about 100 kg/min until said predetermined residual sulfur concentration is achieved.

19. The method of claim 3 wherein, following completion of said magnesium addition, said desulfurizing agent is continued to be added for about 1 to about 6 minutes until the predetermined residual sulfur concentration is achieved.

20. The method of claim 3 wherein said metal is magnesium, and wherein said sulfur content of said molten metal has decreased to about 0.015 wt.%, the magnesium, in granular form, is added to the molten iron at a rate of about 1 to about 40 kg/min over a period of about 1 to about 4 minutes, and following completion of said magnesium addition, said desulfurizing agent is continued to be added for about 1 to about 6 minutes until the preselected residual sulfur concentration is achieved.

* * * * *